United States Patent [19]

Tinsley

[11] Patent Number: 4,817,959

[45] Date of Patent: Apr. 4, 1989

[54] TIME TELLING EDUCATIONAL GAME

[76] Inventor: Judy O. Tinsley, 214 Cedarwood Dr., Salisbury, N.C. 28144

[21] Appl. No.: 86,773

[22] Filed: Aug. 19, 1987

[51] Int. Cl.[4] ..... A63F 3/00; G09B 19/12

[52] U.S. Cl. ..... 273/249; 434/304

[58] Field of Search ..... 273/243, 248, 249; 434/304

[56] References Cited

U.S. PATENT DOCUMENTS

| | | | |
|---|---|---|---|
| 848,839 | 4/1907 | Monroe | 273/141 R |
| 1,125,867 | 1/1915 | Mohr | 273/243 |
| 3,022,582 | 2/1962 | Pitt | 434/304 |
| 3,815,919 | 6/1974 | Cain et al. | 273/249 |

FOREIGN PATENT DOCUMENTS

| | | | |
|---|---|---|---|
| 2738798 | 3/1979 | Fed. Rep. of Germany | 273/249 |

*Primary Examiner*—Anton O. Oechsle

*Attorney, Agent, or Firm*—Jerry T. Kearns

[57] ABSTRACT

An educational game for teaching children to tell time has a playing board with a racetrack printed thereon. Players take turns moving their markers around the race track in accordance with their ability to correctly set the hands of a clock provided on the board to match various times printed on cards drawn from a deck.

8 Claims, 2 Drawing Sheets

TIME TELLING EDUCATIONAL GAME

BACKGROUND OF THE INVENTION

1. Field of the Invention

The present invention relates to educational games, and more particularly pertains to an educational board game for teaching children to tell time. Studies have shown that the learning capacity of young children is enhance when the subject matter is presented in the context of a game. The average attention span of young children in a formal classroom environment is limited. The technological revolution which has taken place in the field of electronics during the last decade has resulted in a large supply of low cost digital watches. These digital watches, costing as little as two dollars, has resulted in a diminution of the abilities of young children to read analog clocks. In order to solve this problem, the present invention provides a competitive educational board game for teaching young children to read analog clocks and watches.

2. Description of the Prior Art

Various types of educational games are known in the prior art. A typical example of such an educational game is to be found in U.S. Design Pat. No. 275,405, which issued to D. Wolf on Sept. 4, 1984. This patent discloses a set of blocks which may be assembled into a configuration resembling the face of an analog clock. U.S. Pat. No. 401,043, which issued to A. Manning on Apr. 9, 1889, discloses a set of blocks or cards with the names of the days of the week, the names of the months, different parts of the day and the days of the months, printed thereon. By the constant handling and inspection of the blocks or cards, a person will become familiar with the calendar, and, though unable to write, may indicate his or her knowledge of the proper divisions of time. Deaf mutes may also use these blocks or cards conveniently for indicating divisions of time without writing the names or numbers. U.S. Pat. No. 2,539,077, which issued to B. Hawkins on Jan. 23, 1951, discloses an electrical educational device for teaching students to tell time. A housing has a clock face with pivotally mounted hands constructed of electrical conducting material which are mounted so as to be insulated from each other. A digital display is also mounted on the housing. An electrical switching network is connected between the clock face and the analog display such that the positioning of the clock hands in correlation with the time indicated on the digital display will complete an electrical circuit and activate an electrical signalling device. U.S. Pat. No. 2,647,330, which issued to S. Ford on Aug. 4, 1953, discloses an educational puzzle for teaching students to tell time. A clock face is formed of twelve different numbered segments having irregularly shaped inner edges. The individual puzzle segments encircle a center piece having clock hands pivotally mounted thereon. The individual puzzle segments are colored in various colors for the purpose of teaching the student the proper sequence of colors in the spectrum. By correctly assembling the segments of the puzzle, the students learns the correct arrangement of the numbers on an analog clock face. U.S. Pat. No. 2,789,370, which issued to J. Studebaker et al on Apr. 23, 1957, discloses an educational workbook which may be utilized to teach students to read an analog clock. The workbook is constructed from a plurality of pairs of leaves containing registering apertures. The first leaf of each pair carries questions, while the second leaf carries corresponding answers. A worksheet on which answers are written by a student is inserted between each pair of leaves. U.S. Pat. No. 4,331,427, which issued to D. Dotson on May 25, 1982, discloses an educational time teaching device. A minute dial has a plurality of coins mounted in a circle, the coins defining a minute scale based upon the value of the coins. A second, hour dial can be detachably mounted on the minute dial in aligned superposed relationship with the periphery of the minute scale. A detachable rotatable hand is usable either with the minute hand alone, or with the two superposed dials. In use, a student is first taught to read the minute hand by demonstration, then the second hour dial is mounted for teaching the student to read the hour hand of an analog clock.

While the above mentioned devices are suited for their intended usage, none of these devices harness the innate human competitive nature to assist in the learning process. Further, none of the aforesaid devices allow active concurrent participation by a group of students. Also, none of these devices utilizes a board game format which is easily understood by students, based upon their previous experience with race course type board games. Inasmuch as the art is relatively crowded with respect to these various types of educational games, it can be appreciated that there is a continuing need for and interest in improvements to such educational games, and in this respect, the present invention addresses this need and interest.

SUMMARY OF THE INVENTION

In view of the foregoing disadvantages inherent in the known types of educational games now present in the prior art, the present invention provides an improved educational game. As such, the general purpose of the present invention, which will be described subsequently in greater detail, is to provide a new and improved educational game which has all the advantages of the prior art educational games and none of the disadvantages.

To attain this, a representative embodiment of the concepts of the present invention is illustrated in the drawings and makes use of a game board having a race track printed thereon. The invention also utilizes a deck of variously printed cards. The invention further provides a clock face printed on the board having clock hands adjustably positionable thereon. Players take turns moving their game markers around the race track in accordance with their ability to correctly set the clock hands in correspondence with various times printed on the cards.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved educational game which has all the advantages of the prior art educational games and none of the disadvantages.

It is another object of the present invention to provide a new and improved educational game which may be easily and efficiently manufactured and marketed.

It is a further object of the present invention to provide a new and improved educational game which is of a durable and reliable construction.

An even further object of the present invention is to provide a new and improved educational game which is susceptible of a low cost of manufacture with regard to both materials and labor, and which accordingly is then susceptible of low prices of sale to the consuming public, thereby making such educational games economically available to the buying public.

Still yet another object of the present invention is to provide a new and improved educational game which provides in the apparatuses and methods of the prior art some of the advantages thereof, while simultaneously overcoming some of the disadvantages normally associated therewith.

Still another object of the present invention is to provide a new and improved educational game for teaching students to read analog clocks and watches.

Yet another object of the present invention is to provide a new and improved educational game which harnesses the innate human competitive nature of students to assist in the learning process.

Even still another object of the present invention is to provide a new and improved educational game which utilizes a race track board game format, familiar to most students, to instruct students to tell time.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
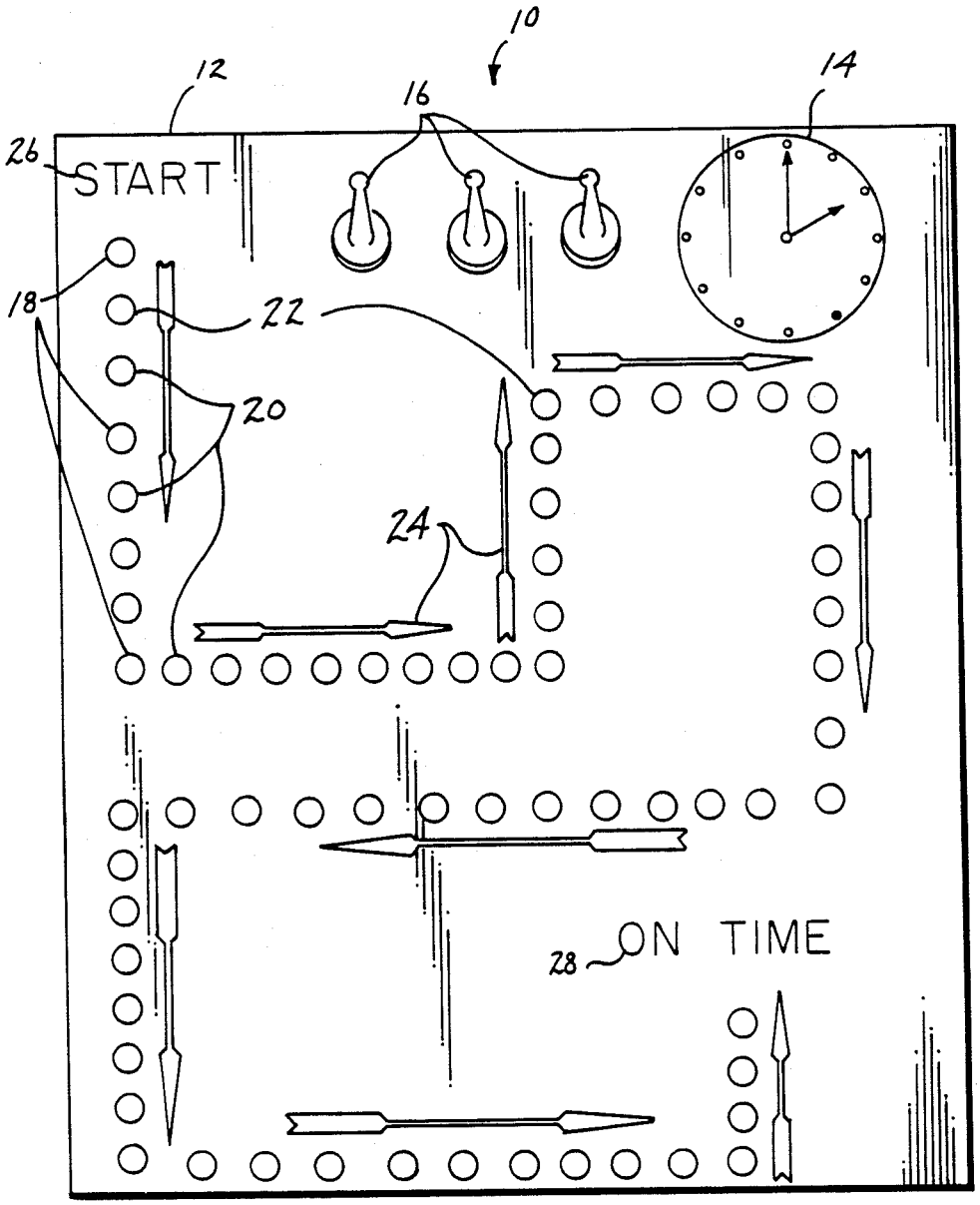
FIG. 1 is a top view of the game board of the present invention.

With reference now to the drawings, and in particular to FIG. 1 thereof, a new and improved educational game embodying the principles and concepts of the present invention and generally designated by the reference numeral 10 will be described.

More specifically, it will be noted that the illustrated embodiment 10 of the invention includes a game board 12 having a race track composed of a plurality of spaced circles printed thereon. The circles are printed in three different colors, for example, circles 18 may be red, circles 20 may be blue and circles 22 may be green. Thus, it may now be understood, that the race track is composed of a trail of spaced circles, each of which is printed either red, blue or green. A clock face 14 having adjustably positionable hands is disposed at an upper corner portion of the game board 12. A plurality of variously colored game markers 16 are provided. Arrows 24 direct the course of movement of the players' markers 16 from a starting position 26 to a finish position 28.

Figure 2:
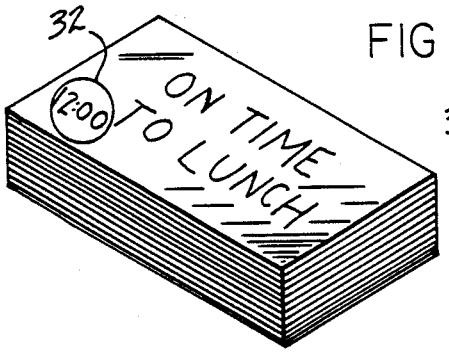
FIG. 2 is a perspective view of a stack of cards of a first type utilized in the present invention.

With reference now to FIG. 2, a first type of cards 30 utilized in the game of the present invention are variously printed with colored circles 32 each having a color selected from one of the colors of circles printed on game board 12. Various assorted times are printed within the circle 32 on each of the cards. The words "ON TIME TO" along with a destination appropriate to the time printed within circle 32 are printed on each card. For example, the top card of the illustrated stack of cards in FIG. 2 is printed with the time "12:00" and the destination "LUNCH".

Figure 3:
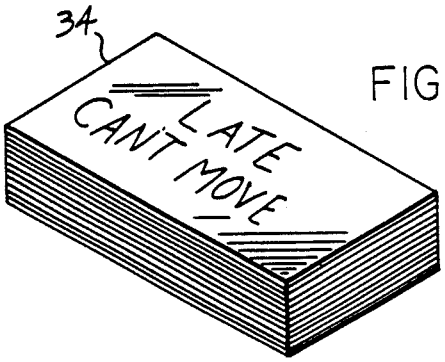
FIG. 3 is a perspective view of a stack of cards of a second type utilized in the present invention.

FIG. 3 illustrates a stack of various "penalty" cards 34. The top card of the stack is a "LATE CAN'T MOVE" card. Various other "penalty" cards such as "GO BACK TWO SPACES", etc. can be provided.

Figure 4:
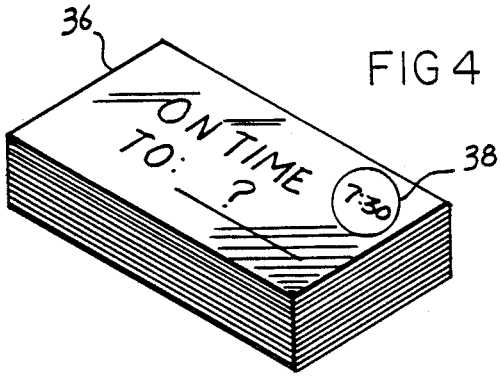
FIG. 4 is a perspective view of a stack of cards of a third type utilized in the present invention.

FIG. 4 illustrates a stack of a third type of card 36 utilized in the play of the game of the present invention. Each card 36 has a variously colored circle 38 printed thereon. The colors of the circle 38 of each card 36 is selected as one of the three colors of the circles printed on game board 12. Various assorted times are printed within each of the circles 38. The words "ON TIME TO: ?" are printed on each card.

The manner of play of the game of the present invention will now be described. The stacks of the three types of cards, shown in FIG. 2, FIG. 3, and FIG. 4, are shuffled together to form a deck of cards. The deck of cards is then turned face down on, or adjacent, the game board 12. The first player draws a card from the top of the deck and turns it face up. If the card is of a type illustrated in FIG. 2, the player attempts to set the hands of the clock 14 to match the time shown in the circle 32 of the card 30. If the player sets the clock hands to the correct time, as adjudged by a referee, the player then advances his game marker 16 from the start position 26 to the next circle on the race track having the same color as circle 32 on card 30. The next player then draws the next card from the top of the deck and turns it face up on top of the card turned by the previous player. If, for purposes of illustration, the card is a "penalty" card 34 as illustrated in FIG. 3, then the player is assessed the penalty printed on the card. In the case of the "LATE CAN'T MOVE" card 34 of FIG. 3, the player is unable to advance his game marker pass the start position 26. The next player then turns the next card from the top of the deck. If, for example, the card is of the type illustrated in FIG. 4, the player attempts to set the hands of the clock 14 to the time printed in the circle 38. If the referee judges the attempt to be unsuccessful, the player is prohibited from advancing his game marker. If, on the other hand, the player correctly positions the hands of the clock 14, the player is then allowed to advance his game marker from the start position 26 along the race track to the next circle matching the color of circle 38 printed on the card 36. The player may also be required to name an activity appropriate to the time printed within the circle 38. Play continues in this fashion, until a player succeeds in advancing his game marker 16 throughout the entire course of the race track to a finish position 28. If the entire deck of cards is turned before any player reaches the finish position 28, the cards are simply reshuffled, and play continues. It should also be mentioned that any number of game markers 16 may occupy a single circle printed on game board 12.

While the race track has been illustrated with three separate colors, it is to be understood that as many different colors as desired may be utilized. Also, while three game markers 16 are illustrated, the game may be played by a larger number of players. The essential inventive concept of the present invention is the provision of a race track type board game for teaching students to read analog clocks and watches.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved educational game for teaching people to tell time, comprising:

game board means;

race track means on said game board means;

clock face means associated with said game board means;

clock hand means adjustably mounted on said clock face means;

a plurality of card means for use in the play of said game;

said plurality of card means consisting of three different types of cards;

one of said different types of cards being "time and activity" cards;

said race track means composed of a plurality of spaced circles of various colors printed on said game board means;

a colored circle having a color corresponding to one of the colors of the circles on said game board means printed on each of said "time and activity" cards; and various times printed on eacch of said circles on said cards.

2. The educational game of claim 1, wherein a plurality of directional arrows are arranged adjacent said race track means on said game board means.

3. The educational game of claim 1, wherein said clock face means is an analog clock face printed in a corner portion of said game board means and said clock hand means consist of an hour hand and a minute hand pivotally mounted on said analog clock face.

4. The educational game of claim 1, wherein a plurality of multi-colored game markers are associated with said game board means.

5. The educational game of claim 1, wherein a "START" position is formed on said race track means.

6. The educational game of claim 1, wherein an "ON TIME" finish position is formed on said race track means.

7. A new and improved educational game, comprising:

a game board having a race track formed from a series of spaced, multi colored, circles;

a series of directional arrows on said game board, adjacent said race track;

a "START" position and an "ON TIME" finish position on said race track;

an analog clock face printed on a corner portion of said game board;

pivotally positionable hour and minute hands mounted on said clock face;

a plurality of variously colored game markers, for movement by players around said race track, associated with said game board;

a deck of cards associated with said game board;

said deck of cards composed of three different types of cards including "penalty" cards, "time and activity" cards and "time and blank" cards;

a variously colored circle corresponding to one of the game board circle colors on each of the "time and activity" and "time and blank" cards; and various times printed on each of said circles on said cards.

8. A new and improved educational game for teaching people to tell time, comprising:

game board means;

race track means on said game board means;

clock face means associated with said game board means;

clock hand means adjustably mounted on said clock face means;

a plurality of card means for use in the play of said game;

said plurality of card means consisting of three different types of cards;

one of said different types of cards being "time and blank" cards;

said race track means composed of a plurality of spaced circles of various colors printed on said game board means;

a colored circle having a color corresponding to one of the colors of the circles on said game board means printed on each of said "time and blank" cards; and various times printed on each of said circles on said cards.

* * * * *